United States Patent [19]

Murano

[11] Patent Number: 4,828,343

[45] Date of Patent: May 9, 1989

[54] ROLL TOWEL CABINET

[75] Inventor: Mitsuru Murano, Yokohama, Japan

[73] Assignee: Nippon Steiner Co., Ltd., Tokyo, Japan

[21] Appl. No.: 214,823

[22] Filed: Jul. 5, 1988

Related U.S. Application Data

[63] Continuation-in-part of Ser. No. 32,520, filed as PCT JP86/00633 on Dec. 15, 1986, Published as WO87/03463 on Jun. 18, 1987, abandoned.

[30] Foreign Application Priority Data

Dec. 16, 1985 [JP] Japan ..... 60-281131

[51] Int. Cl.[4] ..... B65H 19/00

[52] U.S. Cl. ..... 312/38

[58] Field of Search ..... 312/37–41

[56] References Cited

U.S. PATENT DOCUMENTS

| | | | |
|---|---|---|---|
| 1,721,928 | 7/1929 | Steiner | 312/38 |
| 2,470,187 | 5/1949 | Price | 312/38 |
| 2,839,345 | 6/1951 | Engel et al. | 312/38 X |
| 3,637,274 | 1/1972 | Manuel | 312/38 |

*Primary Examiner*—Joseph Falk

*Attorney, Agent, or Firm*—Gerald J. Ferguson, Jr.

[57] ABSTRACT

A roller towel cabinet in which when an unused roll towel (32) wound in a roll shape is pulled out for usage, a used portion of the roll towel is simultaneously wound. The unused portion of the roll towel is sequentially pulled out in the state of contacting the first roller (40) and sequentially wound up in the state of being pinched between a roll-up shaft (38) and a second roller (62). The first roller (40) is coupled with the second roller (62) by mechanical transmission means (65) and the first and second rollers are rotatably supported on an arm member (50) rotatably disposed on a base frame (21). The arm member (50) is constituted to apply a rotating force to the roll-up shaft (38) in the state that the second roller (62) is constantly pressing the used roll towel, and to be rotatable in accordance with the increment of the diameter of the used roll towel thereby maintaining the pulling force of the unused portion of the roll towel in a substantial uniform.

6 Claims, 6 Drawing Sheets

ROLL TOWEL CABINET

This application is a continuation of Ser. No. 032,520, filed as PCT JP86/00633 on Dec. 15, 1986, published as WO87/03463 on Jun. 18, 1987, now abandoned.

TECHNICAL FIELD

The present invention relates to a roll towel cabinet in which an unused towel wound in a roll shape is pulled out to be used and the used towel portion is simultaneously wound up on a roll-up shaft.

BACKGROUND ART

Some types of the conventional roll towel cabinet provide an arrangement that when a portion of the roll towel which is unused and clean is pulled out from the cabinet, and the used towel portion having the same length as the pulled portion of the towel is wound up into the cabinet.

FIG. 1 shows a schematic construction of such conventional roll towel cabinet. In FIG. 1, a cabinet body 1 is fixed on a wall 2 by means of a suitable supporting member, and there is disposed a towel bed 3*a* for receiving an unused roll towel 3 in the cabinet body 1, the roll towel 3 being adapted to be held in a predetermined region when the roll towel 3 is pulled out from the cabinet body 1. The roll towel 3 is pulled out from an opening 1*a* provided at the lower portion of the cabinet body 1 along the direction shown by arrow A in the state that the roll towel 3 is pinched between an elongated roller 4 both ends of which are rotatably supported by the cabinet body 1 and another elongated roller or a pinch roller 5.

The portion of the unused towel pulled out from the opening 1a is maintained so as to form a loop 6 and used, and then the used portion is pulled into the cabinet body 1 from another opening 1*b* mounted at the lower portion of the cabinet body 1 as shown by arrow B and wound on a roll-up shaft 7 both ends of which are rotatably supported by the cabinet body.

In order to roll up the used portion of the towel on the roll-up shaft 7 by the same length as the unused portion pulled out, the rotation of the roller 4 is synchronized with that of the roll-up shaft 7. There is provided a sprocket 8 at one end of the elongated roller 4 and the sprocket 8 is connected to a sprocket 10 by a chain 9, the sprocket 10 being provided at one end of an elongated roller 11 both ends of which are rotatably supported by the cabinet body 1 and being contacted with a portion of the used portion of the towel wound on the roll-up shaft 7.

Therefore, when the unused portion of the towel is pulled in the direction shown by arrow A, the roller 4 and the sprocket 8 are clockwise rotated and then the roller 11 is clockwise rotated through the chain 9 and the sprocket 10. By the clockwise rotation of the roller 11, the used portion of the towel is counterclockwise wound.

According to such conventional device, since the diameter of the used roll towel is gradually increased as the towel is used, the roller 11 is rotatably mounted to the cabinet body 1, and the roll-up shaft 7 is adapted to be movable with respect to the cabinet body 1. In FIG. 1, the roll-up shaft 7 is moved in a direction shown by arrow D and the final diameter of the used roll towel is denoted by a two-dotted line 12. Both ends of the roll-up shaft 7 are supported by a pair of guide members having guide grooves (not shown) provided on the inner walls of the cabinet body 1 along the direction shown by arrow D. Therefore, the roll-up shaft 7 moves upwardly along the grooves, as the diameter of the used roll towel is gradually increased. At the initiation of the rolling-up operation for the used towel, the peripheral surface of the roller 11 is contacted with the peripheral surface of the roll-up shaft 7 by the weight of the roll-up shaft 7 per se. As the diameter of the used roll towel is increased, the peripheral surface of the roller 11 is contacted with the used roll towel wound up on the roll-up shaft 7 by the sum of the weight of the roll-up shaft 7 per se and the weight of the used roll towel wound on the roll-up shaft 7, therefore the force required for rotating the roller 4 by pulling the towel in the direction of A is gradually increased undesirably. In brief, the force required for pulling the unused towel is gradually increased after the initiation. This is very inconvenient. Furthermore, since the roll-up shaft 7 is arranged to be guided along the grooves of the guide member mounted on the cabinet body 1, and a portion of the weight of the used roll towel is loaded not only on the roller 11 but also the guide member, it is necessary to form the guide member by a rigid material such as stainless steel thereby undesirably making the whole cabinet weighty and expensive.

An object of the present invention is to present a roll towel cabinet for eliminating the disadvantages of the conventional roll towel cabinet mentioned above.

Other object of the present invention is to present a roll towel cabinet in which the pulling operation of an unused portion of a roll towel can be made by a substantially uniform force and the used portion of the roll towel can be surely rolled up.

Further object of the present invention is to present a roll towel cabinet with a light weight in which there is provided a compact arrangement for rolling up a used portion of a roll towel, and a loading of an unused towel into a cabinet are made easily.

DISCLOSURE OF THE INVENTION

In a roll towel cabinet of the present invention, there are provided a first roller adapted to be rotated by the pulling force of an unused portion of a roll towel and a second roller for applying a rotation force to the roll-up shaft for rolling up the used towel portion by closely contacting the used roll towel, the first roller being coupled to the second roller by mechanical transmission means, and the first and second rollers being rotatably mounted on an arm member rotatably mounted on a base frame. The arm member is formed in such a manner that the second roller constantly presses the used roll towel, and the second roller moves in accordance with the rotation of the arm member in contact with the used roll towel, as the used roll towel is increased in a diameter as the unused towel portion is pulled out. By this, it is possible to substantially and uniformly maintain the pulling force of the unused towel portion and therefore users can pull thereby providing convenience for users.

The arm member may be preferably arranged so as to be rotated around the same axis as the rotation axis of the first roller, and the first roller is not moved with respect to the base frame even when the used towel portion is rolled up on the roll-up shaft and the diameter thereof is increased, therefore the position at which the unused towel is contacted with the first roller is fixed at a constant position thereby stabling the pulling operation of the unused towel portion.

If there is provided a third roller arranged in such a manner that the third roller is contacted with a portion of the periphery of the first roller and moved in accordance with the movement of the first roller due to the rotation of the arm member, the pulling operation of the unused towel portion becomes further stable and the roll-up operation of the used towel portion becomes further stable. Especially, in the case where the rotation axis of the arm member is not coincident with the rotation axis of the first roller, namely in the case where the first and second rollers are rotatably mounted in the arm member, and the arm member is arranged to be rotatable around an axis the position of which is shifted from the rotation axis of the first roller; the first roller rotates around the rotation axis of the arm member and the third roller is arranged such that the axis of the third roller moves in accordance with the movement of the first roller, therefore the unused towel portion is constantly contacted with the first roller thereby making the pulling operation stable.

By providing the cover member for covering the base frame so as to be movable with respect to the base frame and by providing the third roller to be movable at the inside of the cover, a new roll towel can be easily loaded on the first roller. Namely, the loading operation of the new roll towel is effected such that the cover is at first opened to expose the base frame, the new roll towel being loaded on the towel bed, one end of the new roll towel being pulled and then fixed to the roll-up shaft over the first roller. Then, the cover is closed thereby sandwiching the unused towel portion between the third roller and the first roller.

According to the roller towel cabinet of the present invention, all parts of the roll towel cabinet can be made by non-metallic material such as plastic except the base frame, therefore it is possible to reduce the weight of the roll towel cabinet remarkably.

BRIEF DESCRIPTION OF THE DRAWINGS

FIG. 2 is a schematic perspective view showing the external appearance of the roll towel cabinet, FIG. 3 is a perspective view showing the mechanism of an unused towel for pulling-out and rolling-up, and FIG. 4 is a schematic side view for explaining the pulling-out operation of the unused towel and rolling-up operation of the used towel;

MODE FOR CARRYING OUT THE INVENTION

With reference to FIGS. 2 to 6 embodiment of a roll towel cabinet of the present invention is explained hereinafter.

Figure 1:
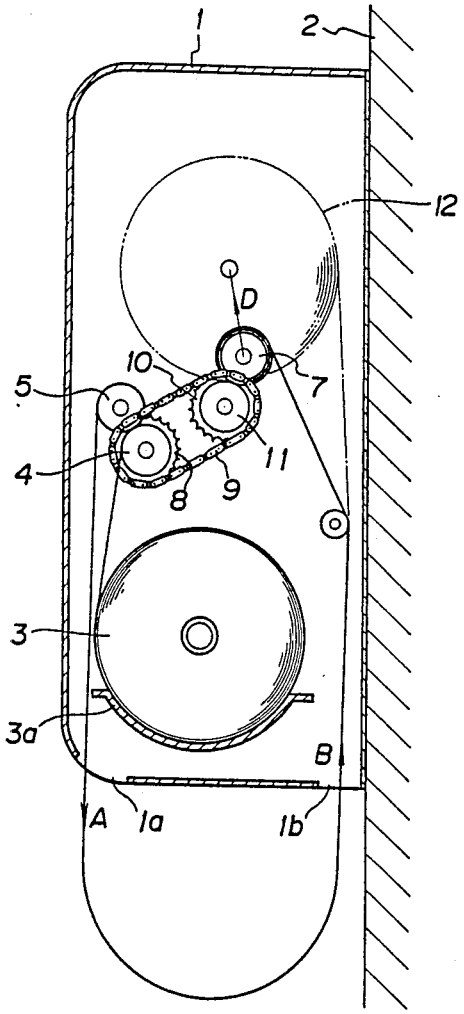
Fig. 1 PRIOR ART
FIG. 1 is a schematic view for explaining a conventional roll towel cabinet.
Figure 2:
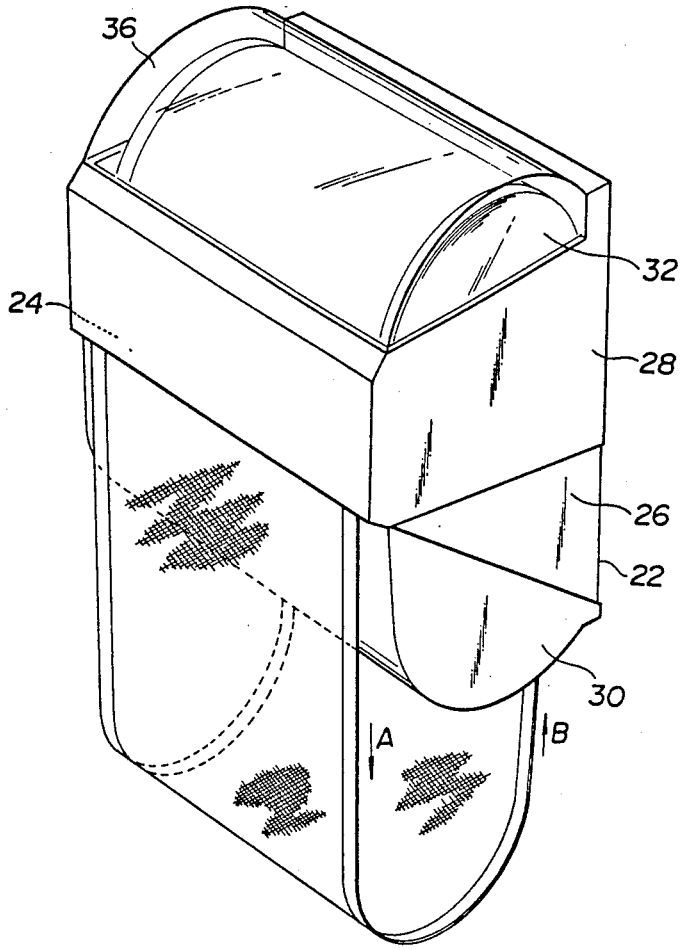
FIGS. 2 to 4 show an example of the roll towel cabinet of the present invention.

FIG. 2 is a perspective view for schematically showing whole of the roll towel cabinet, and numeral 21 denotes a base frame to be fixed on a member such as wall. The base frame 21 is composed of a back wall 22 to be fixed on the wall and a pair of side walls 24 and 26 extended perpendicularly from the back wall 22. There is disposed an upper cover 28 or a shell at an upper portion of the back wall 22, the upper cover 28 being openably mounted on the back wall 22 by using two hinges, and similarly there is disposed a bottom cover 30 at a lower portion of the back wall 22. An unused roll towel 32 is held on a towel bed 34 mounted on the base frame 21 (see FIG. 4). There is provided a window 36 formed by transparent plastics on the shell 28, and the retained amount of the unused roll towel 32 can be observed from the external through the windows 36.

Figure 4:
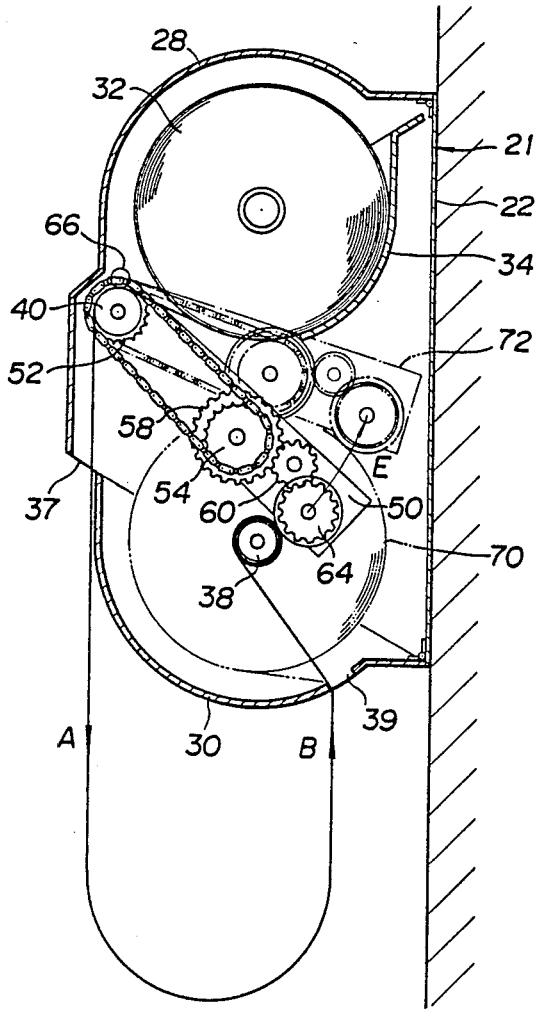

As seen in FIGS. 2 and 4, the unused roll towel 32 is pulled out in a direction shown by arrow A from a first opening 37 formed at the lower portion of the shell 28, and rolled up in a direction shown by arrow B from a second opening 39 formed at the bottom cover 30. Namely, one end of the unused roll towel 32 is suitably fixed on a roll-up shaft 38 horizontally and rotatably mounted on two side walls 24 and 26 of the base frame 21 and the roll-up shaft 38 can be rotated simultaneously upon pulling the unused portion of the roll towel 32 to wind up the used portion having the same length as that of the pulled portion. A pulling-out and rolling-up mechanism for the roll towel will be explained in detail hereinafter.

Figure 3:
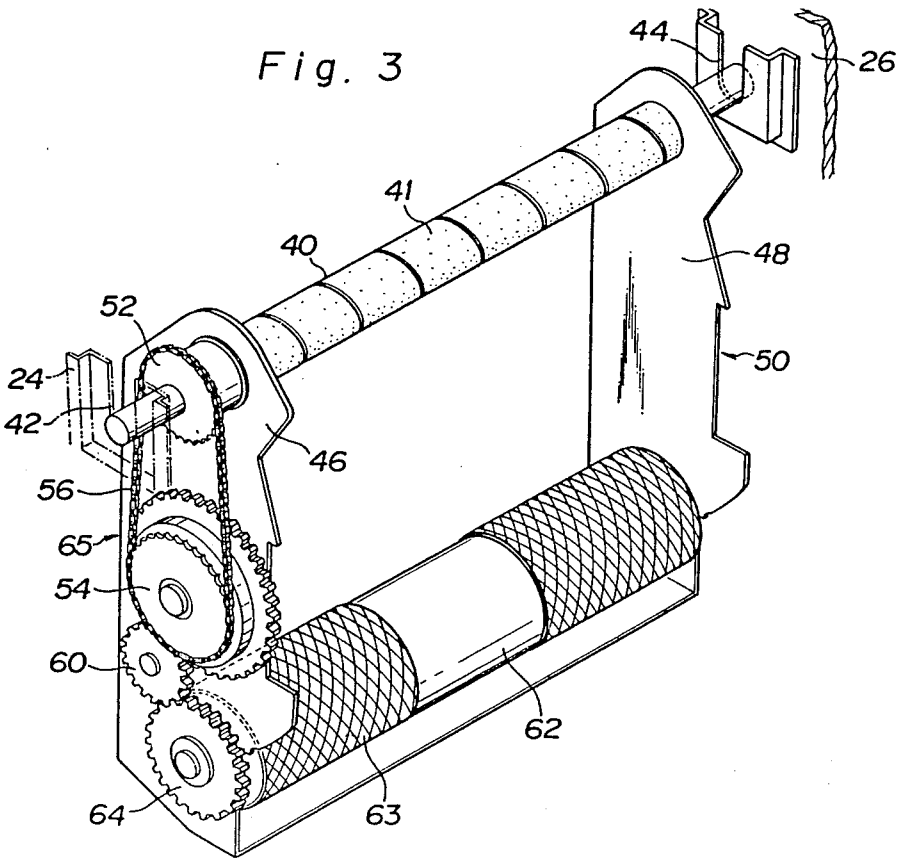

In FIG. 3, numeral 40 denotes a first roller both ends of which are rotatably supported by U-shaped bearings or mounting brackets 42 and 44 formed on the side walls 24 and 26 of the base frame 21 respectively, and the first roller 40 has a function as a rotation axis of an arm member 50 having a pair of arms 46 and 48. There is provided through-holes on the pair of arms 46 and 48 for passing through the first roller 40 and the arm member 50 can be rotated around the first roller 40. At one end of the first roller 40 a first sprocket 52 is fixed, and the first sprocket 52 is coupled with a second sprocket 54 rotatably mounted on the arm 41 by a chain 56. There is provided a first gear 58 coaxially mounted on the rotation axis of the second sprocket 54, and the first gear 58 is coupled with a second gear 60 rotatably mounted on the arm 46. The second gear 60 is coupled with a third gear 64 fixed on one end of a second roller 62 rotatably supported on the arms 46 and 48. The above-mentioned first sprocket 52, chain 56, second sprocket 54, and first, second third gears 58, 60 and 64 compose mechanical transmission means 65 for transmitting the rotation of the first roller 40 to the second roller 62. The first roller 40 and the second roller 62 are horizontally disposed in parallel with each other. The inner surface of the unused roll towel is contacted with the peripheral surface of the first roller 40 as shown in FIG. 4. Furthermore, there is provided a third roller 66, i.e. a pinch roller, as shown in FIG. 4, for contacting the front surface of the unused towel and applying a predetermined pressing force to the periphery of the first roller 40. The third roller 66 is mounted on the end point of a lever 68 rotatably supported at the inside of the shell 28, and the unused towel portion of the roll towel is sandwiched between the third roller 66 and the first roller 40 when the shell 28 is closed after loading the unused roll towel 32.

There is preferably provided a frictional member 41 such as a sand paper on the periphery of the first roller 40 for maintain a good contact between the periphery of the first roller 40 and the roll towel 32. Furthermore, it is preferable to provide spring means mounted between the inside of the shell 28 and the lever 68 for urging the third roller 66 toward the first roller 40. By this constitution, the unused portion of the roll towel sandwiched between the first roller 40 and the third roller 66 can be closely contacted to the first roller 40 when the shell 28 is closed, and the rotation of the first roller 40 can be surely effected when the unused portion is pulled in the direction A as shown in FIG. 4.

The rotation of the first roller 40 is transmitted to the second roller 62 through the above-mentioned transmission means 65, and the rotation of the second roller 62 is transmitted to the roll-up shaft 38. The arm member 50 is rotatable around the first roller 40 with respect to the base frame 21, and the roll-up shaft 38 is placed within the moving locus of the second roller 62. Therefore, the direction of pressing force applied to the roll-up shaft 38 from the second roller 62 is constant. There is provided a frictional member 63 such as rubber on the periphery of the second roller 62 for surely winding the used portion of the roll towel on the roll-up shaft 38 without any slip therebetween.

As the unused roll towel 32 is sequentially pulled out in the direction A, the diameter of the used roll towel wound up on the roll-up shaft 38 is gradually increased, and the arm member 50 is pressed upwardly in the direction shown by arrow E. The increased diameter of the used roll towel is shown by the two dotted line 70 in FIG. 4 and the position of the arm member 50 at the time is shown by the two dotted line 72.

Figure 5:
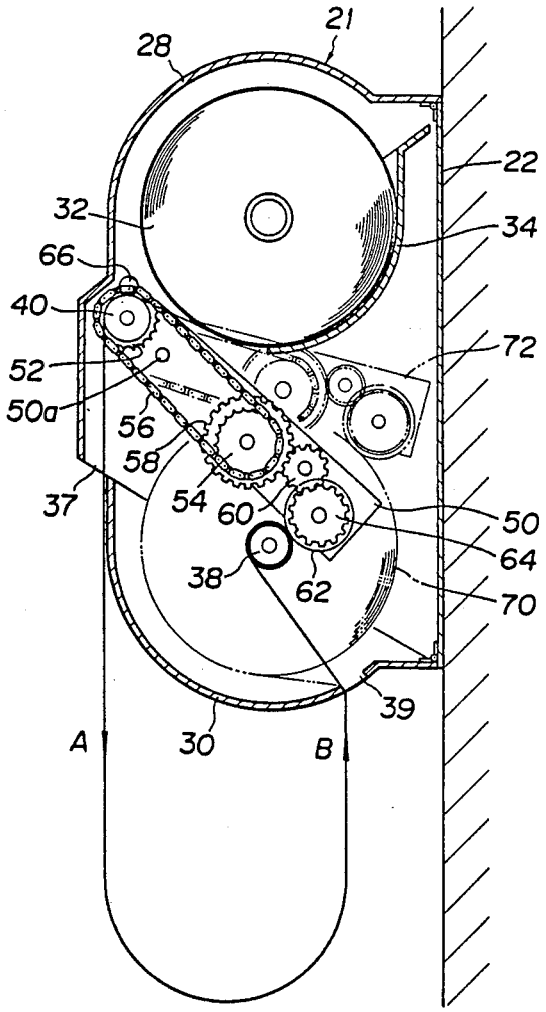
FIG. 5 is a schematic side view for explaining the operation of the pulling-out and rolling-up mechanism for the roll towel, in the case where the rotation axis of the arm member is shifted from the rotation axis of the first roller.
Figure 6:
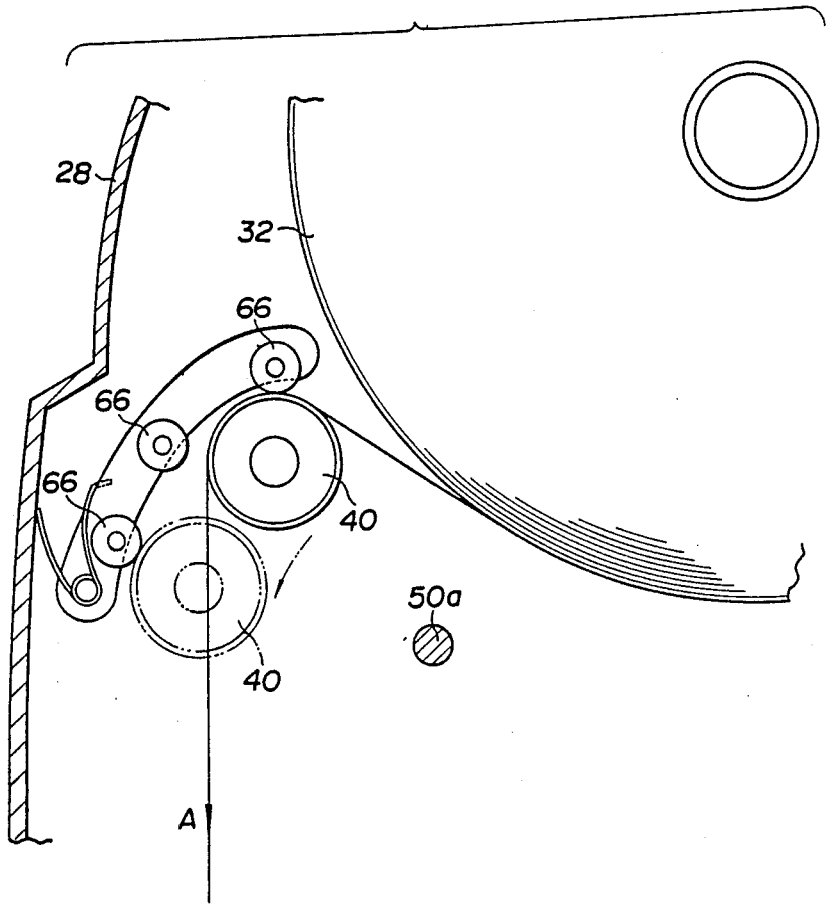
FIG. 6 is a partially enlarged view for explaining the operation of the third roller for pulling out the unused towel in FIG. 5.

In this embodiment of the present invention, the arm member 50 is constituted in such a manner that the rotation axis of the arm member 50 coincides with the rotation axis of the first roller 40, however it is possible to shift the rotation axis 50*a* of the arm member 50 from the rotation axis of the first roller 40 as shown in FIG. 5 schematically. In such case, the first roller 40 is adapted to be rotatable with respect to the arm member 50, the first roller 40 does not contact the base frame 21. Furthermore, there are provided a pair of projections (not shown) forming the rotation axes 50*a* respectively on the paired arms 46 and 48 of the arm member 50, and there are formed grooves (not shown) on the side walls 24 and 26 of the base frame 21 for supporting the projections respectively. In such constitution the weight balance of the arm member 50 is important. In order to avoid the fact that the arm member 50 is counterclockwise rotated around the rotation axis 50*a* when the unused portion is instantaneously pulled in the direction A, it is required to weight the side of the arm member 50 at which the second roller 62 is mounted, thereby making large the clockwise moment. As the unused towel is sequentially pulled out, the diameter of the used towel is gradually increased, and the arm member 50 rotates counterclockwise around the rotation axis 50*a* gradually and the first roller 40 also rotates counterclockwise around the rotation axis 50*a* gradually. At the time, the contact surface between the unused towel and the first roller 40 moves as shown in FIG. 6, therefore if a plurality of third rollers 66 (three rollers in FIG. 6) are disposed along the moving path of the first roller 40 so as to make the first roller 40 contact with which roller necessarily, it becomes possible to surely rotate the first roller 40 upon pulling the unused towel.

As mentioned above, according to the roll towel cabinet of the present invention, the roll-up shaft 38 for the used towel is rotatably supported by the base frame forming the cabinet body 1 and it does not move as the conventional device in the process in which the unused towel is sequentially pulled out, and further the used roll towel wound on the roll-up shaft 38 is closely contacted with the second roller 62 constantly by the weight of the arm member 50 per se, therefore it well be understood that the unused towel can be pulled out by a constant pulling force thereby being surely wound on the roll-up shaft 38. Furthermore, the pulling-out and rolling-up mechanism for the roll towel is installed at the arm member compactly, therefore the loading of the newly unused roll towel can be performed easily.

Furthermore, it may be possible to use grooved wheels and a V-belt as mechanical transmission means for transmitting the rotation of the first roller 40 to the second roller 62 without using the sprockets 52 and 54 and the chain 56, therefore the present invention should not restricted to sprockets and a chain.

Furthermore, according to the present invention, the provision of guide means by steel material for guiding the roll-up shaft as seen in the conventional device is not necessary, therefore it can be possible to form all parts except the base frame by light material such as plastic thereby remarkably reducing the weight of the roll towel cabinet.

What is claimed is:

1. A roll towel cabinet having a towel bed for receiving an unused roll towel comprising:

a base frame fixable on a wall;

an arm member pivotably supported on said base frame and having a pair of arms disposed apart from each other, a first roller rotatably supported between said paired arms of said arm member and holding the unused portion of said roll towel on a portion of the periphery of said first roller, said first roller having a longitudinal axis, a second roller rotatably supported between said paired arms of said arm member and disposed substantially in parallel with said first roller, and mechanical transmission means for transmitting the rotation of said first roller to said second roller;

said arm member being pivotable, relative to said base frame, about said longitudinal axis of said first roller, said second roller having a locus of motion during pivoting of said arm member;

means for rotating said first roller during pulling-out of an unused towel portion from the unused roll towel; and a roll-up shaft for winding used towel, rotatably mounted with respect to said base frame, said roll-up shaft being disposed in said locus of motion of said second roller due to the rotation of said arm member and also being disposed substantially in parallel with said second roller;

said arm member being constantly urged to press said used roll towel with a portion of the periphery of said second roller;

wherein frictional contact between said second roller and wound-up portions of the used roll towel causes said roll-up shaft to operate when unused towel is being removed; and wherein as unused towel is being removed the diameter of the used roll towel wound upon said roll-up shaft increases and contact between said second roller and the used roll towel wound upon said roll-up shaft moves said second roller away from said roll-up shaft to pivot said arm member.

2. A roll towel cabinet according to claim 1, wherein said arm member is arranged to be rotated around the rotation axis coaxially disposed with the rotation axis of the first roller.

3. A roller towel cabinet according to claim 2, wherein said mechanical transmission means includes a first sprocket (52) fixed at one end of said first roller, a second sprocket rotatably mounted on an arm corresponding to said one end of said first roller, a chain coupled between said first and second sprockets, and gear means including a first gear coaxially fixed with said second sprocket, and a second gear coaxially fixed with said second roller for being mechanically coupled to said first gear.

4. A roller towel cabinet according to claim 1, wherein said arm member is adapted to be rotated around the rotation axis disposed at a shifted position from the rotation axis of said first roller.

5. A roller towel cabinet according to claim 1, further comprising a third roller arranged to be in contact with a portion of the periphery of said first roller and the axis of said third roller moves in accordance with the movement of said first roller.

6. A roller towel cabinet according to claim 4, further comprising covers disposed movably on said base frame for covering said base frame, and said third roller is rotatably mounted at the inside of said cover.

* * * * *